US011779856B2

(12) United States Patent
Chang

(10) Patent No.: US 11,779,856 B2
(45) Date of Patent: Oct. 10, 2023

(54) SMOKE GENERATOR USING DRY ICE

(71) Applicant: NOVACORP INC., Guangzhou (CN)

(72) Inventor: Ming-Cheng Chang, Tainan (TW)

(73) Assignee: NOVACORP INC., Guangzhou (CN)

( * ) Notice: Subject to any disclaimer, the term of this patent is extended or adjusted under 35 U.S.C. 154(b) by 657 days.

(21) Appl. No.: 17/001,886

(22) Filed: Aug. 25, 2020

(65) Prior Publication Data

US 2022/0062783 A1 Mar. 3, 2022

(51) Int. Cl.
*A63J 5/02* (2006.01)

(52) U.S. Cl.
CPC ..... *A63J 5/025* (2013.01)

(58) Field of Classification Search
CPC ..... A63J 5/025; F17C 7/04; F17C 9/02
See application file for complete search history.

(56) References Cited

U.S. PATENT DOCUMENTS 5,957,382 A * 9/1999 Thomas ..... F41H 9/06 239/14.1
6,400,897 B1 * 6/2002 Lin ..... F04B 9/14 392/405
2002/0050141 A1 * 5/2002 Tomita ..... F17C 9/02 62/48.1
2007/0012063 A1 * 1/2007 Schock ..... F41H 9/08 62/425
2008/0016885 A1 * 1/2008 Hoover ..... A63J 5/025 62/50.2
2021/0162312 A1 * 6/2021 Tomazetich ..... B05B 7/1686
2023/0063250 A1 * 3/2023 Li ..... A63J 5/025

FOREIGN PATENT DOCUMENTS

CN 108721917 * 11/2018
EP 3954447 A2 * 7/2022
JP 04341293 A * 11/1992

OTHER PUBLICATIONS

English translation of CN 10872917, Nov. 2, 2018. (Year: 2018).*

* cited by examiner

*Primary Examiner* — Marc E Norman

(57) ABSTRACT

A smoke generator includes a casing having a first chamber receiving dry ice, a second chamber receiving water, and a third chamber. The casing includes an outer side having a smoke outlet intercommunicating with the second chamber. The first chamber includes a smoke discharge port intercommunicating with the second chamber. A water pump device in the third compartment includes a water inlet located in the second chamber and a water spraying end located in the first chamber. The water pump device delivers water in the second chamber to the first chamber. The dry ice contacts with the water and gasifies into smoke that enters the second chamber via the smoke discharge port and is then ejected out via the smoke outlet. Water in the first chamber is flowable back to the second chamber. A heater is disposed in the second chamber and can increase the temperature of the water.

12 Claims, 9 Drawing Sheets

SMOKE GENERATOR USING DRY ICE

BACKGROUND OF THE INVENTION

The present invention relates to a smoke generator and, more particularly, to a smoke generator using dry ice that directly sublimes into gaseous carbon dioxide when heated, thereby providing a smoke effect.

Dry ice (the solid form of carbon dioxide) sublimes under heat and turns into a gaseous state providing a smoke effect. Dry ice smoke generators are designed based on the characteristics of dry ice and control the volume and timing of production of smoke generated from dry ice. A conventional dry ice smoke generator generally includes a basket with a plurality of holes. Dry ice is received in the basket. Hot water is disposed below the basket. When generation of smoke is not desired, the basket is in a position in which the dry ice in the basket is spaced from the hot water. When generation of smoke is desired, the basket moves towards the hot water until the dry ice comes into contact with the hot water. Thus, the dry ice absorbs heat and sublimes into the gaseous state to produce a large amount of smoke, and the dry ice smoke generator conveys the smoke to the outside to produce a smoke effect.

However, the above conventional dry ice smoke generator cannot provide a good temperature maintaining effect, because the dry ice has to be immersed into the hot water and is, thus, not isolated from the hot water. Therefore, the dry ice is independently stored in a temperature keeping box outside of the dry ice smoke generator before use. In use, the dry ice is removed out of the temperature keeping box and is then placed into the dry ice smoke generator, which is inconvenient to use. Furthermore, the temperature of the hot water reduces the preservation period of the dry ice during use. Due to the poor temperature keeping effect of the dry ice smoke generator, the dry ice is continuously consumed even not in use. In a case that the performance time is long, the dry ice in the dry ice smoke generator could have been run out or insufficient to provide the desired smoke effect, and it is improper to replenish the dry ice on the stage during the performance time.

Furthermore, due to the operation of the conventional dry ice smoke generator requiring movement of the basket to immerse dry ice into hot water, the capacity of the dry ice smoke generator is at least twice the volume of the dry ice to permit total immersion in the hot water. Thus, most currently available dry ice smoke generator do not have a large capacity for dry ice, leading to a small yield and a small period of time of smoke generation. However, since the basket has to move together with the dry ice, the basket could be too heavy to move when loaded with a large quantity of dry ice. Furthermore, a bulky dry ice smoke generator is not suitable for disposition on a stage and is, therefore, not an optimal solution.

BRIEF SUMMARY OF THE INVENTION

In a first aspect, the present invention provides a smoke generator using dry ice and comprising a casing including a first chamber, a second chamber, and a third chamber. The casing includes an outer side having a smoke outlet intercommunicating with the second chamber. The first chamber includes a smoke discharge port intercommunicating with the second chamber. The first chamber is configured to receive dry ice. The second chamber is configured to receive water. A separation member is disposed between the first chamber and the second chamber and located below the smoke discharge port. The separation member includes a water draining port intercommunicating with the first and second chambers. The separation member is disposed inclinedly to locate the water draining port in a lowest location of the separation member. A water pump device is fixed in the third compartment. The water pump device includes a water inlet located in the second chamber and a water spraying end located in the first chamber. The water pump device is configured to deliver water in the second chamber to the first chamber. A heater is disposed in the second chamber and configured to increase a temperature of the water. A water discharge mechanism is coupled to the separation member. The water discharge mechanism includes a valve plate normally in a first position closing the water draining port and a support spring biasing the valve plate to the first position. The valve plate is movable between the first position closing the water draining port and a second position revealing the water draining port. When a water level of the water in the first chamber rises to a height and imparts a load force to the valve plate to thereby overcome the support spring, the valve plate moves from the first position to the second position. The water in the first chamber flows back to the second chamber.

The smoke generator according to the present invention uses the water pump device to deliver the water in the second chamber to the first chamber. The water discharge mechanism permits the water in the first chamber to flow back into the second chamber. Therefore, the dry ice can continuously contact with the water at a higher temperature without moving the dry ice, and the dry ice can gasify to provide a smoke effect after efficiently absorbing the heat of the water. In comparison with a conventional smoke generator having the same volume (but a portion of the volume is used to permit relative displacement of the basket and the dry ice), more dry ice can be received in the smoke generator according to the present invention, prolonging the time for generating smoke. Namely, the operation time of the smoke generator is prolonged.

In an example, a bottom wall is formed between the first and second chambers and is inclined. The bottom wall includes a through-hole extending between the first and second chambers. The separation member is disposed to the bottom wall and covers the through-hole. The water draining port intercommunicates with the through-hole when the valve plate is in the second position. The bottom wall disposed inclinedly permits the water draining port to be disposed at the lowest position of the bottom wall. This allows the water in the first chamber to be smoothly discharged from the water draining port into the second chamber.

In an example, the smoke generator further comprises an isolation cap including a front opening intercommunicating with the smoke outlet and a lower opening intercommunicating with the front opening. The first chamber is defined by a peripheral wall located in the second chamber and a bottom wall located at a bottom end of the peripheral wall and extending inclinedly. The bottom wall includes a through-hole extending between the first and second chambers. The separation member is disposed to the bottom wall and covers the through-hole. The smoke discharge port is misaligned from the smoke outlet. The isolation cap is fixed between the peripheral wall and the smoke outlet and is misaligned from the smoke discharge port. The lower opening faces the smoke discharge port and intercommunicates with the second chamber.

In an example, an overflow preventing member is disposed at the smoke discharge port and is located in the second chamber. The overflow preventing member includes a coupling portion disposed around the smoke discharge port and a baffle having an end coupled to the coupling portion. The coupling portion includes a through-hole aligned with the smoke discharge port. A distal end of the baffle is located above a bottom of the through-hole.

In an example, a smoke discharge valve is pivotably mounted to the smoke discharge port and is located in the second chamber. The smoke discharge valve normally blocks the through-hole of the overflow preventing member when not subject to force. When the first chamber is filled with smoke and the internal pressure in the first chamber is larger than a sum of a pressure in the second chamber and a weight of the smoke discharge vale, the smoke in the first chamber pushes open the smoke discharge valve and enters the second chamber via the through-hole and the smoke discharge port.

In an example, the separation member includes a thermally insulating layer spaced from the water draining port.

In an example, the separation member includes an enclosing wall around the water draining port. The enclosing wall includes a plurality of holes configured to permit passage of water through the water draining port.

In an example, a basket is detachably mounted in the first chamber. The basket includes plurality of water draining holes and at least one track portion on a face thereof. The dry ice is received in the basket. At least one positioning portion is fixed in the first chamber. The positioning portion is detachably coupled to the at least one track portion of the basket.

In another aspect, a smoke generator using dry ice comprises a casing including a first chamber, a second chamber, and a third chamber. The casing includes an outer side having a smoke outlet intercommunicating with the second chamber. The first chamber includes a smoke discharge port intercommunicating with the second chamber. The first chamber is configured to receive dry ice. The second chamber is configured to receive water. A water pump device is fixed in the third compartment and configured to deliver water in the second chamber to the first chamber. The dry ice contacts with the water and gasifies into smoke that enters the second chamber via the smoke discharge port and is then ejected out via the smoke outlet. The water in the first chamber is flowable back to the second chamber. A heater is disposed in the second chamber and configured to increase a temperature of the water.

In an example, the smoke generator further comprises an isolation cap including a front opening intercommunicating with the smoke outlet and a lower opening intercommunicating with the front opening. The first chamber is defined by a peripheral wall located in the second chamber and a bottom wall located at a bottom end of the peripheral wall and extending inclinedly. The smoke discharge port is misaligned from the smoke outlet. The isolation cap is fixed between the peripheral wall and the smoke outlet and is misaligned from the smoke discharge port. The lower opening faces the smoke discharge port and intercommunicates with the second chamber.

The present invention will become clearer in light of the following detailed description of illustrative embodiments of this invention described in connection with the drawings.

Figure 1:
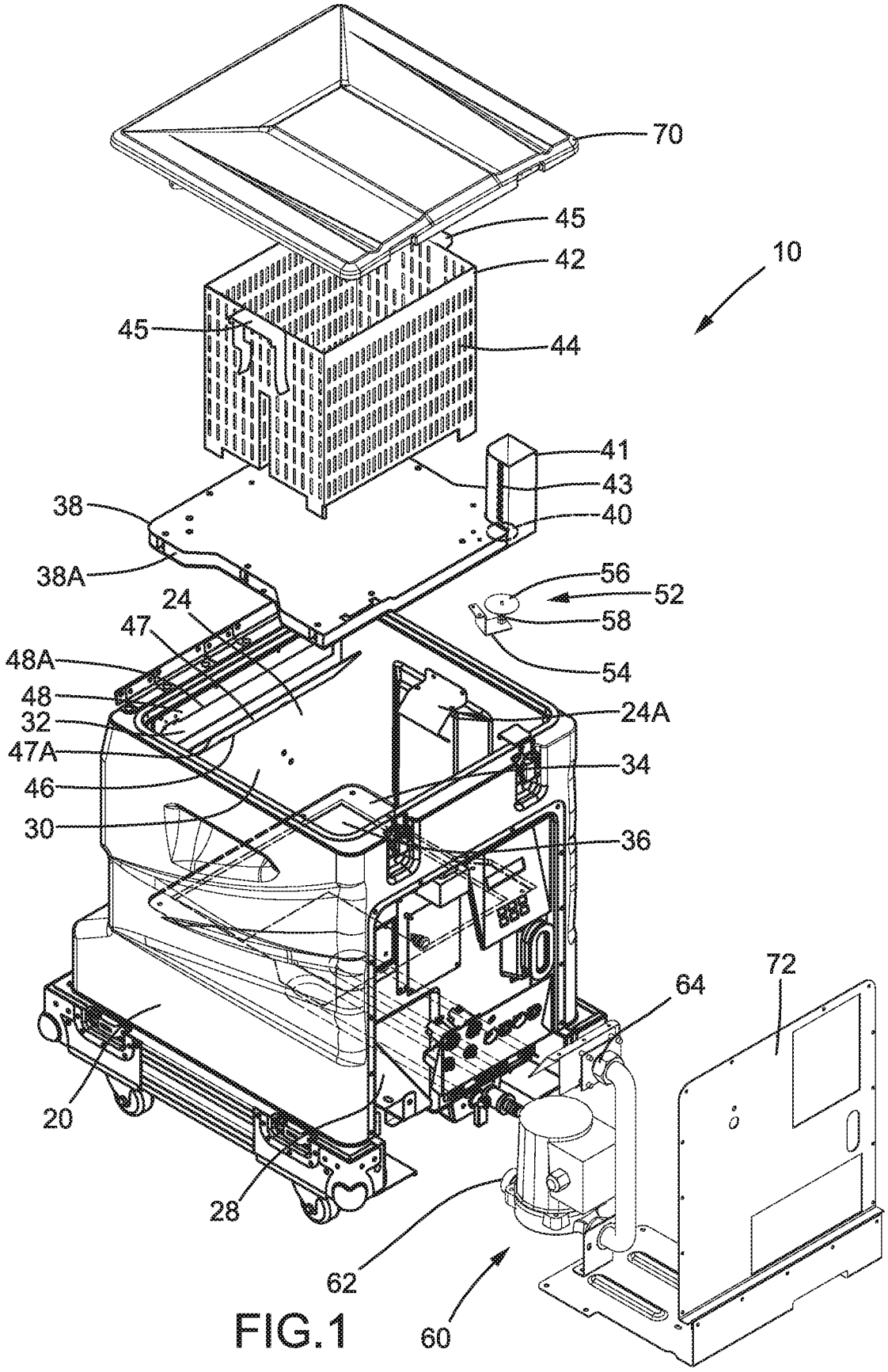
FIG. 1 is an exploded, perspective view of a smoke generator using dry ice of an embodiment according to the present invention.
Figure 2:
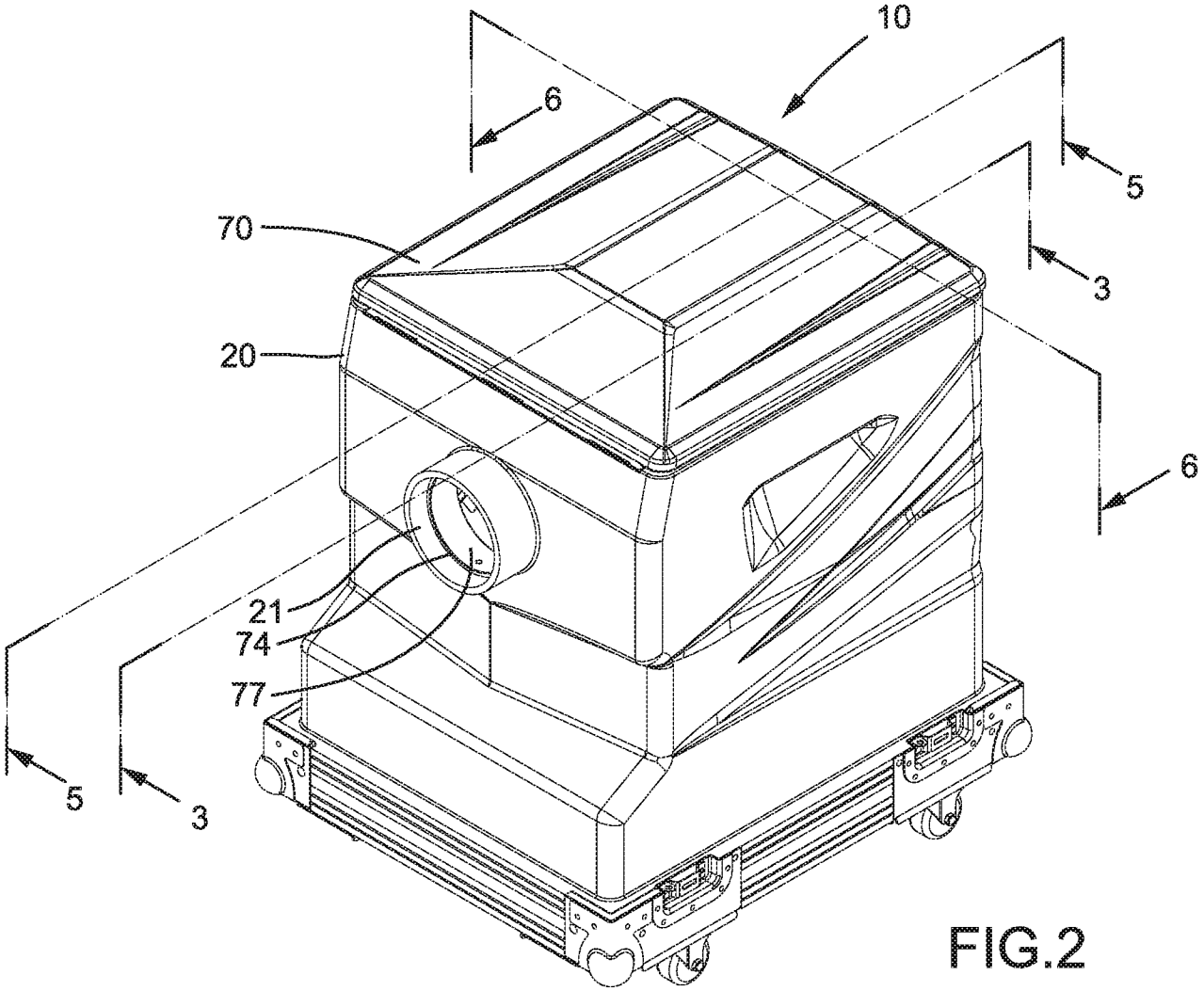
FIG. 2 is a perspective view of the smoke generator of FIG. 1.
Figure 3:
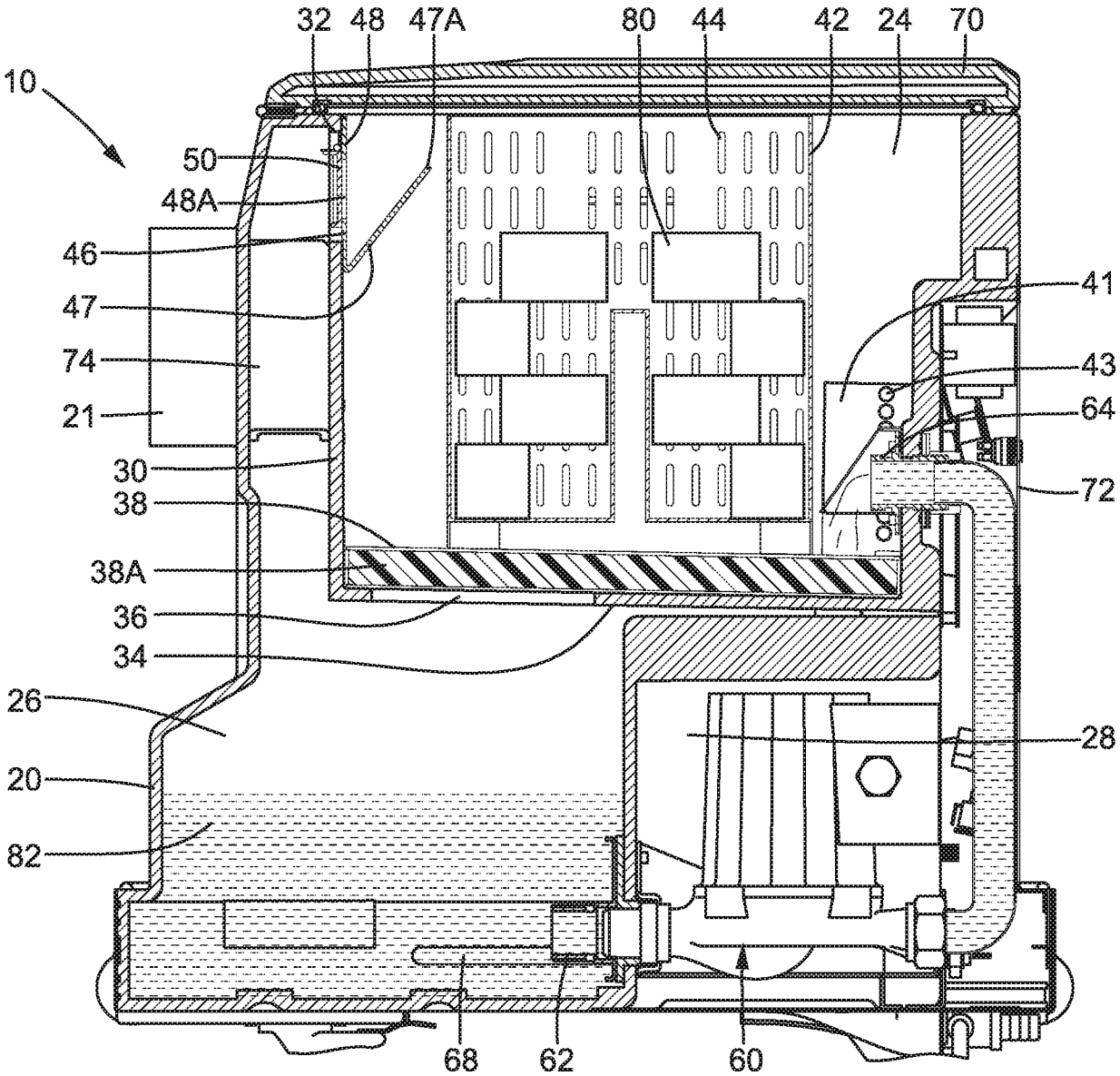
FIG. 3 is a cross sectional view taken along section line 3-3 of FIG. 2.
Figure 4:
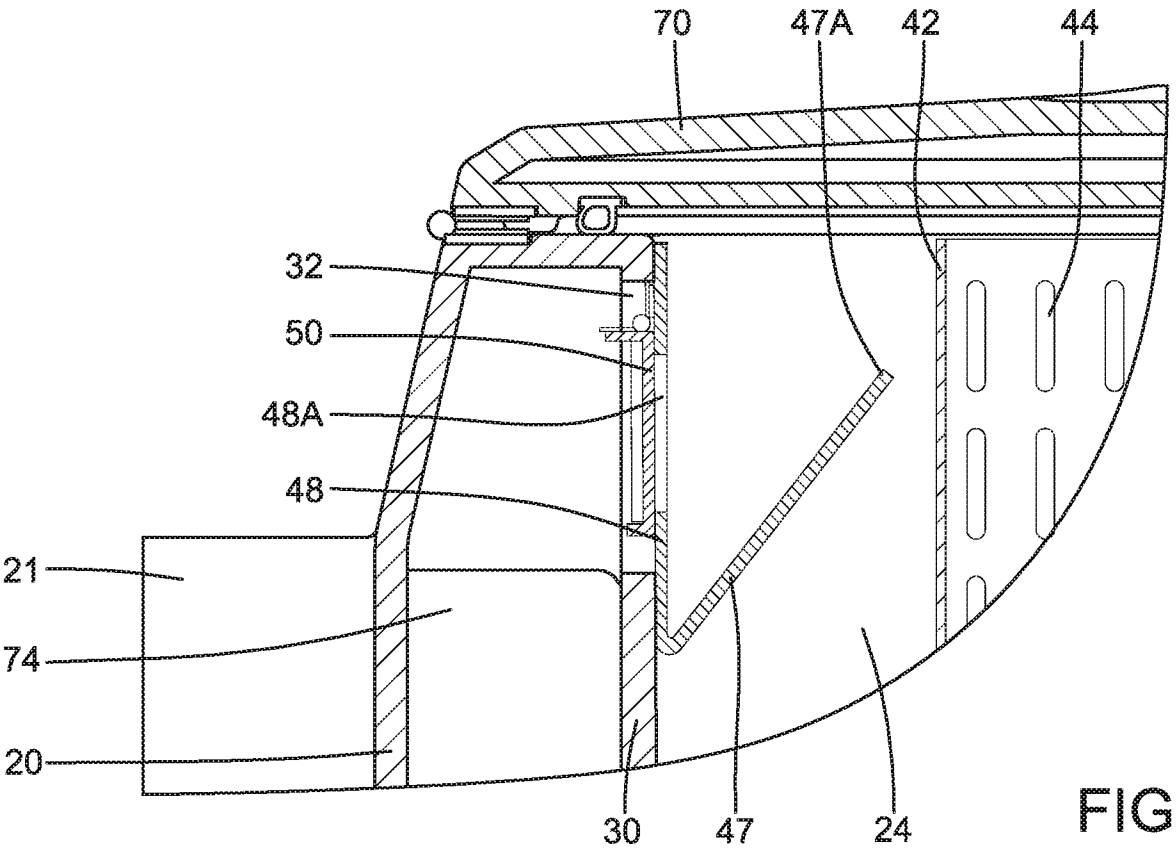
FIG. 4 is an enlarged view of a portion of FIG. 3.
Figure 5:
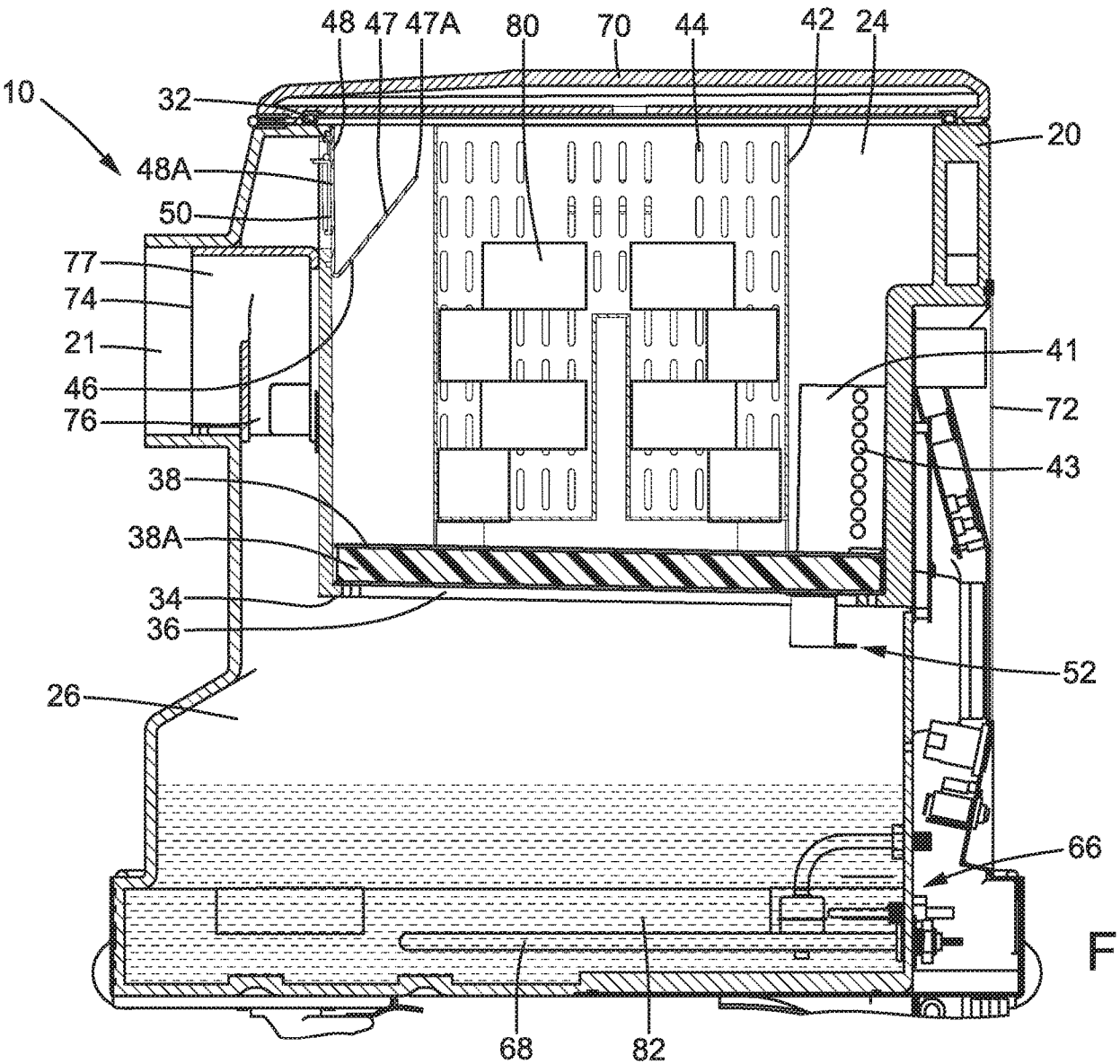
FIG. 5 is a cross sectional view taken along section line 5-5 of FIG. 2.
Figure 6:
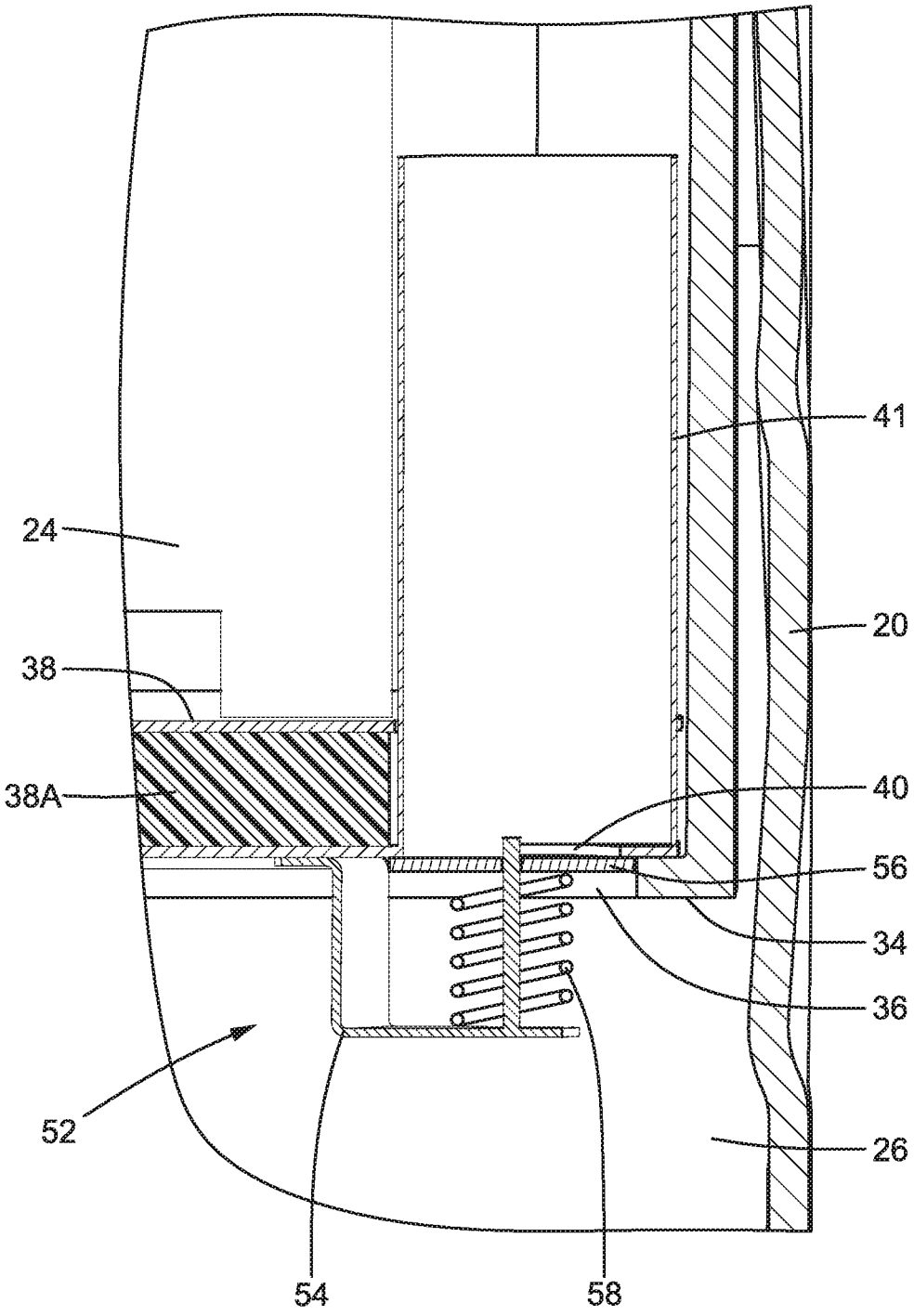
FIG. 6 is a cross sectional view taken along section line 6-6 of FIG. 2.

All figures are drawn for ease of explanation of the basic teachings of the present invention only; the extensions of the figures with respect to number, position, relationship, and dimensions of the parts to form the embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "lower", "upper", "outer", "side", "end", "portion", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

With reference to FIGS. 1-6, a smoke generator 10 of an embodiment according to the present invention directly gasifies dry ice to produce smoke. The smoke generator 10 includes a casing 20 having a first chamber 24, a second chamber 26, and a third chamber 28 separated from the first chamber 24 and the second chamber 26.

The casing 20 further includes a smoke outlet 21 in an outer face thereof and intercommunicating with the second chamber 26. The first chamber 24 is defined by a peripheral wall 30 located in the second chamber 26 and a bottom wall 34 extending inclinedly from a bottom end of the peripheral wall 30 towards a corner. Namely, the first chamber 24 is located in the second chamber 26. The peripheral wall 30 includes a smoke discharge port 32. The smoke discharger 32 and the smoke outlet 21 are on the same side but misalign from each other. The smoke discharger 32 is located above the smoke outlet 21 and is adjacent to an upper opening of the first chamber 24. The bottom wall 34 includes a through-hole 36 extending between the first chamber 24 and the second chamber 26. A corner of the inclined bottom wall 34 is lower than the remaining corners of the bottom wall 34. The third chamber 28 is formed by recessing an outer face of the casing 20.

An overflow preventing member 46 is disposed on the peripheral wall 30 and is aligned with the smoke discharge port 32. The overflow preventing member 46 includes a coupling portion 48 disposed around the smoke discharge port 32 and a baffle 47 having an end coupled to the coupling portion 48. The coupling portion 48 includes a through-hole 48A aligned with the smoke discharge port 32. A distal end 47A of the baffle 47 is located above a bottom of the through-hole 48A.

A smoke discharge valve 50 is disposed in the smoke discharge port 32 and is pivotably mounted to the coupling portion 48 of the overflow preventing member 46. The smoke discharge valve 50 normally blocks the through-hole 48A of the overflow preventing member 46 when not subject to force.

The smoke generator 10 further includes a separating member 38 fixed in the first chamber 24 and a water discharge mechanism 52 located between the first chamber 24 and the second chamber 26. The separating member 38 includes a thermally insulating layer 38A in the form of an intermediate layer. The separating member 38 further includes a water draining port 40 in a corner thereof and an enclosing wall 41 around the water draining port 40. The enclosing wall 41 includes a plurality of holes 43 having a small size. The separating member 38 is fixed to the bottom wall 34 and covers the through-hole 36. The water draining port 40 intercommunicates with the through-hole 36 and is located in the lowest corner of the bottom wall 34. The thermally insulating layer 38A is used to reduce the heat exchange between the first chamber 24 and the second chamber 26.

Figure 9:
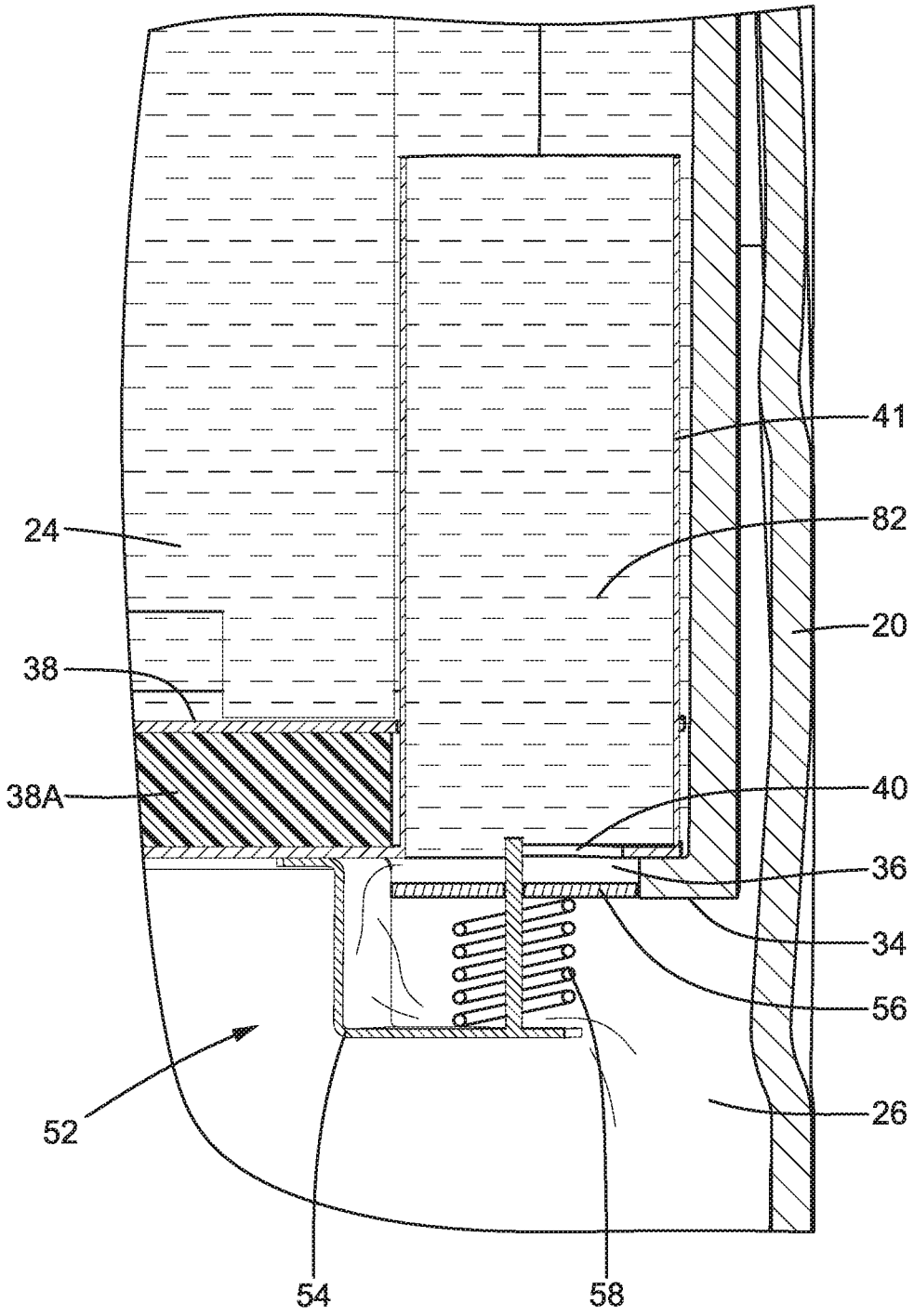
FIG. 9 is a view similar to FIG. 6 with a valve plate moved to a releasing position.

The water discharge mechanism 52 is coupled to the separating member 38 and includes a supporting seat 54, a valve plate 56, and a support spring 58 disposed between the valve plate 56 and the supporting seat 54. The supporting seat 54 is fixed to a bottom of the separating member 38 and is located in the second chamber 26. The valve plate 56 is movably coupled to the supporting seat 54 and is movable between a first position (FIG. 6) revealing the water draining port 40 and a second position (FIG. 9) closing the water draining port 40. The support spring 58 biases the valve plate 56 to the second position closing the water draining port 40.

A basket 42 is detachably received in the first chamber 24 and includes a plurality of water draining holes 44 and two track portions 45 on two opposite sides thereof. The first chamber 24 includes two positioning portions 24A disposed on the peripheral wall 30 and corresponding to the two track portions 45. When the basket 42 is received in the first chamber 24, the two track portions 45 are detachably coupled with the two positioning portions 24A to locate the basket 42 in a central portion of the first chamber 24. The basket 42 is configured to receive at least one piece of dry ice 80.

According to the form shown, the smoke generator 10 further includes a water pump device 60 and a heating device 66. The water pump device 60 is fixed in the third chamber 28 and can be comprised of a water pump. The water pump device 60 further includes a water inlet 62 located in the second chamber 26 and a water spraying end 64 located in the first chamber 24. When the water pump device 60 operates, water in the second chamber 26 is delivered to the first chamber 24.

The heating device 66 is disposed in the casing 20 and includes a heater 68 located on a bottom of the second chamber 26. The heater 68 is configured to heat water in the second chamber 26, increasing the water temperature.

A side lid 72 is fixed on a face of the casing 20 and is aligned with the third chamber 28. The side lid 72 covers the third chamber 28. A cover 70 is pivotably mounted to an upper end of the casing 20 and is located at an opening of the first chamber 24. The cover 70 closes the first chamber 24 when in a closed position.

The smoke generator 10 further includes an insolation cap 74. The isolation cap 74 includes a front opening 77 aligned with the smoke outlet 21 (which is misaligned from the smoke discharge port 32) and a lower opening 76 aligned with the second chamber 26 and facing the smoke discharge port 32. The isolation cap 74 is disposed between the smoke outlet 21 and the peripheral wall 30. An end of the front opening 77 is received in the smoke outlet 21. The lower opening 76 of the isolation cap 74 faces the heater 68 in the second chamber 26.

For sake of explanation, it is assumed that 8 pieces of dry ice 80 are placed in the basket 42. Water 82 of a suitable amount is received in the second chamber 26 and has a depth sufficient to immerse the heater 68 of the heating device 66. The water 82 is at a normal temperature when the smoke generator 10 is not running. The dry ice 80 is separated from the water 82 by the separation member 38. Thus, the dry ice 80 can be well preserved when the smoke generator 10 is not running.

Figure 7:
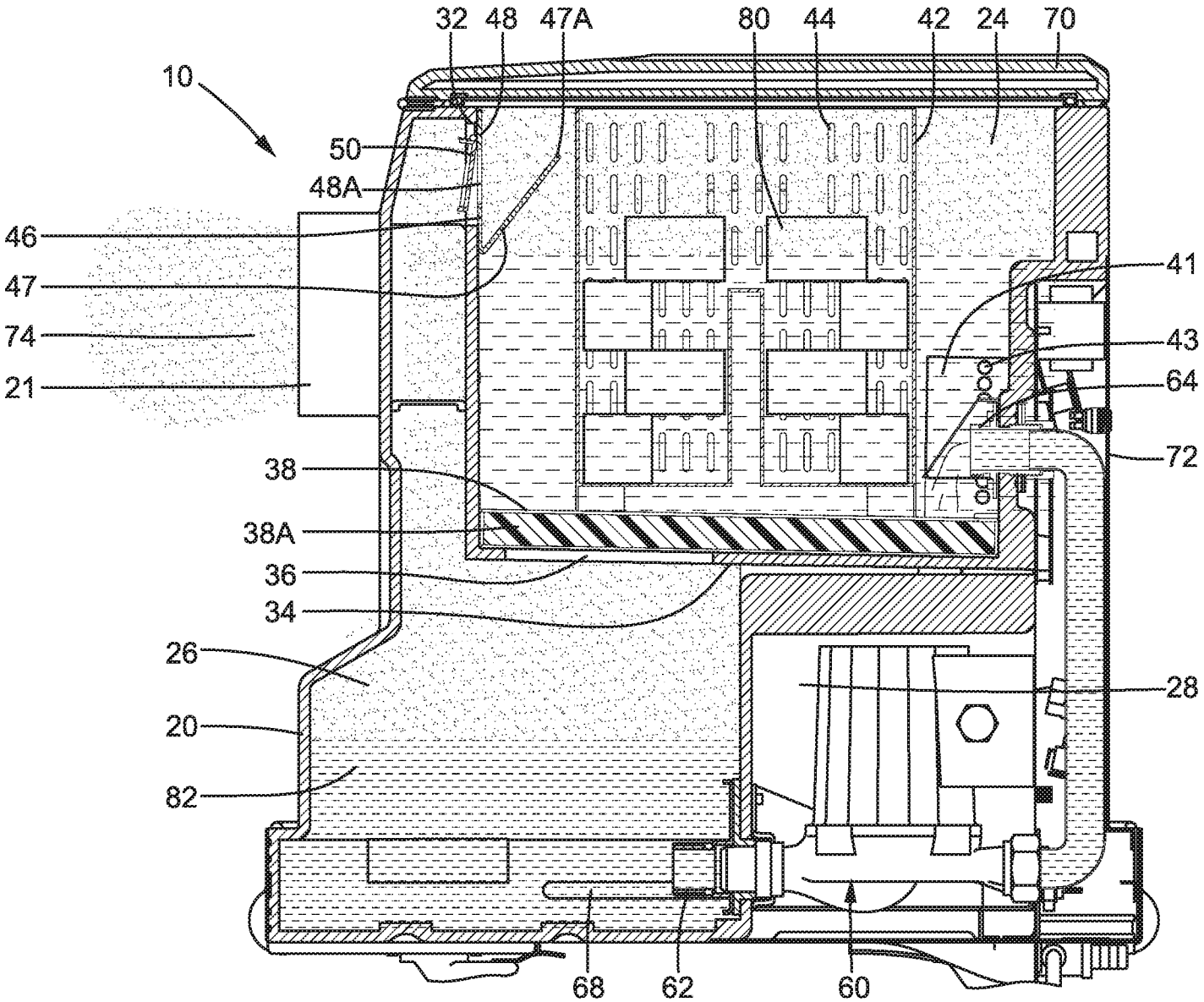
FIG. 7 is a cross sectional view similar to FIG. 3, illustrating a status of the smoke generator while generating smoke.
Figure 8:
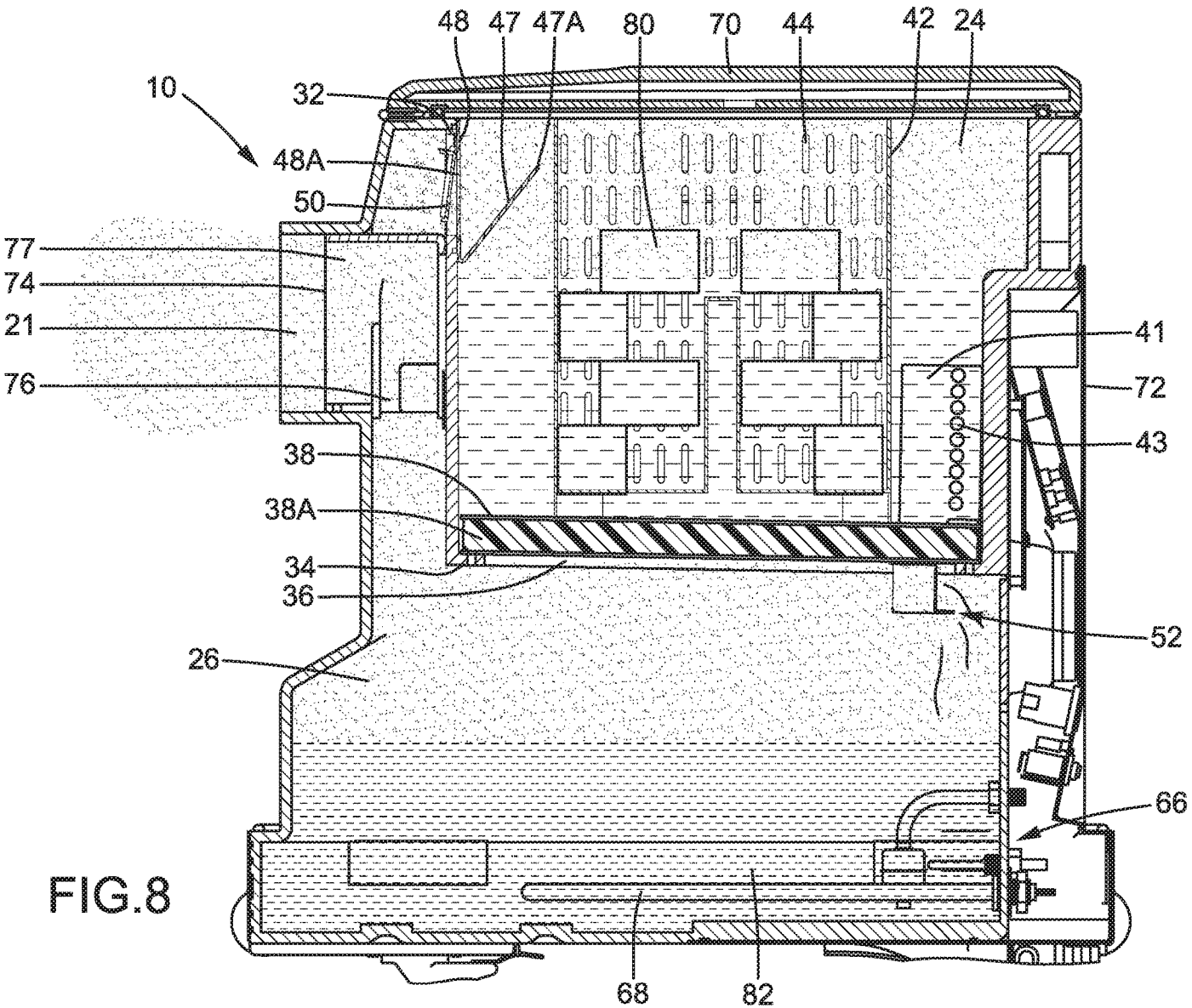
FIG. 8 is a cross sectional view similar to FIG. 5, illustrating a status of the smoke generator while generating smoke.

With reference to FIGS. 7-8, when it is desired to generate smoke, the heater 68 heats the water 82 to increase the temperature. The water pump device 60 sucks the water 82 at a higher temperature via the water inlet 62 and discharges the water 82 via the water spraying end 64, such that the water level in the first chamber 24 rises. When the water 82 at a higher temperature in the first chamber 24 rises and enters the basket 42 via the plurality of water draining holes 44 to contact with the dry ice 80, the dry ice 80 absorbs heat from water and gasified into smoke. When the smoke fills the first chamber 24 to an extent in which the internal pressure in the first chamber 24 is larger than a sum of the pressure in the second chamber 26 and the weight of the smoke discharge vale 50, the smoke in the first chamber 24 pushes open the smoke discharge valve 50 and enters the water-free remaining space in the second chamber 26 via the through-hole 48A and the smoke discharge port 32.

It is noted that due to the isolation cap 74, the smoke emerging from the first chamber 24 will not be directly discharged via the smoke outlet 21. Since the lower opening 76 of the isolation cap 74 is spaced from the smoke discharge port 32, the smoke emerging from the first chamber 24 will firstly enter and spread throughout the second chamber 26, then passes through the lower opening 76 and the front opening 77 of the isolation cap 74, and finally squirts out of the smoke outlet 21. The advantage of this design is the water vapor resulting from the water 82 at a higher temperature is less likely to be ejected out of the first chamber 24 together with the smoke. Therefore, the smoke ejected out of the smoke outlet 21 is drier. Furthermore, the baffle 47 of the overflow preventing member 46 can prevent water, water spray, or moisture induced into the first chamber 24 from overflowing via the through-hole 48A or the smoke discharge port 32.

Furthermore, when the water in the first chamber 24 passes through the plurality of holes 43 in the peripheral wall 41 into an interior of the peripheral wall 41, the water pressure increases the pressure imparted to the valve plate 56. When the pressure (a load force) imparted to the valve plate 56 exceeds the biasing force of the support spring 58, the valve plate 56 moves from the second position closing the water draining hole 40 to the first position revealing the water draining port 40. Thus, water filled into the first chamber 24 can flow through the water draining port 40 and the through-hole 36 and then flow back into the second chamber 26, such that the water 82 whose temperature is reduced can be heated again.

The smoke generator 10 according to the present invention uses the water pump device 60 to deliver the water 82 in the second chamber 26 to the first chamber 24. The water discharge mechanism 52 permits the water in the first chamber 24 to flow back into the second chamber 26. Therefore, the dry ice 80 can continuously contact with the water 82 at a higher temperature without moving the dry ice 80, and the dry ice 80 can gasify to provide a smoke effect after efficiently absorbing the heat of the water 82. In comparison with a conventional smoke generator having the same volume (but a portion of the volume is used to permit relative displacement of the basket and the dry ice), more dry ice 80 can be received in the smoke generator according to the present invention, prolonging the time for generating smoke. Namely, the operation time of the smoke generator 10 is prolonged.

Since the basket 42 and the dry ice 80 do not have to move, it is not necessary to consider the load issue of displacement of the dry ice 80 while designing the smoke generator 10. Even though the basket 42 is enlarged and, thus, increases the load, the operation of the whole smoke generator 10 is not directly affected. This further allows an increase in the volume of the smoke generator 10 to receive more dry ice 80 in the smoke generator 10, further effectively prolonging the operation time of the smoke generator 10.

By controlling the flow of the plurality of holes 43 and the water pump device 60, the water level in the first chamber 24 can be easily controlled. The water level in the first chamber 24 is lower when the flow of the water pump device 60 is smaller, and a smaller amount of smoke is generated. On the other hand, the water level in the first chamber 24 is higher when the flow of the water pump device 60 is larger, and a larger amount of smoke is generated.

Another advantage of the smoke generator 10 according to the present invention is the separation member 38 disposed between the first chamber 24 and the second chamber 26. The thermally insulating layer 38A of the separation member 38 can reduce the heat conduction from the water 82 to the interior of the first chamber 24. This further prolongs the preservation time of the dry ice 80 in the first chamber 24.

Since the lower opening 76 of the isolation cap 74 faces the heater 68, the water vapor resulting from the water 82 at a higher temperature is less likely to be ejected out of the first chamber 24 together with the smoke. Therefore, the smoke ejected out of the smoke outlet 21 is drier.

Due to disposition of the overflow preventing member 46, the possibility of the water in the first chamber 24 passing through the smoke discharge port 32 is effectively reduced. The isolation cap 74 further reduces the risk of water dripping through the smoke outlet 21.

The bottom wall 34 disposed inclinedly permits the water draining port 40 to be disposed at the lowest position of the bottom wall 34. This allows the water 82 in the first chamber 24 to be smoothly discharged from the water draining port 40 into the second chamber 26.

Now that the basic teachings of the present invention have been explained, many extensions and variations will be obvious to one having ordinary skill in the art. For example, the smoke generator 10 does not have to include the basket 42, and the dry ice 80 can still be received in the first chamber 24 and can directly gasify into smoke after contacting with hot water.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A smoke generator using dry ice, comprising:

a casing including a first chamber, a second chamber, and a third chamber, wherein the casing includes an outer side having a smoke outlet intercommunicating with the second chamber, wherein the first chamber includes a smoke discharge port intercommunicating with the second chamber, wherein the first chamber is configured to receive dry ice, and wherein the second chamber is configured to receive water;

a separation member disposed between the first chamber and the second chamber and located below the smoke discharge port, wherein the separation member includes a water draining port intercommunicating with the first and second chambers, wherein the separation member is disposed inclinedly to locate the water draining port in a lowest location of the separation member;

a water pump device fixed in the third compartment, wherein the water pump device includes a water inlet located in the second chamber and a water spraying end located in the first chamber, wherein the water pump device is configured to deliver water in the second chamber to the first chamber;

a heater disposed in the second chamber and configured to increase a temperature of the water; and a water discharge mechanism coupled to the separation member, wherein the water discharge mechanism includes a valve plate normally in a first position closing the water draining port and a support spring biasing the valve plate to the first position, wherein the valve plate is movable between the first position closing the water draining port and a second position revealing the water draining port, wherein when a water level of the water in the first chamber rises to a height and imparts a load force to the valve plate to thereby overcome the support spring, the valve plate moves from the first position to the second position, and the water in the first chamber flows back to the second chamber.

2. The smoke generator using dry ice as claimed in claim 1, wherein a bottom wall is formed between the first and second chambers and is inclined, wherein the bottom wall includes a through-hole extending between the first and second chambers, wherein the separation member is disposed to the bottom wall and covers the through-hole, and wherein the water draining port intercommunicates with the through-hole when the valve plate is in the second position.

3. The smoke generator using dry ice as claimed in claim 1, further comprising an isolation cap including a front opening intercommunicating with the smoke outlet and a lower opening intercommunicating with the front opening, wherein the first chamber is defined by a peripheral wall located in the second chamber and a bottom wall located at a bottom end of the peripheral wall and extending inclinedly, wherein the bottom wall includes a through-hole extending between the first and second chambers, wherein the separation member is disposed to the bottom wall and covers the through-hole, wherein the smoke discharge port is misaligned from the smoke outlet, wherein the isolation cap is fixed between the peripheral wall and the smoke outlet and is misaligned from the smoke discharge port, and wherein the lower opening faces the smoke discharge port and intercommunicates with the second chamber.

4. The smoke generator using dry ice as claimed in claim 1, wherein an overflow preventing member is disposed at the smoke discharge port and is located in the second chamber, wherein the overflow preventing member includes a coupling portion disposed around the smoke discharge port and a baffle having an end coupled to the coupling portion, wherein the coupling portion includes a through-hole aligned with the smoke discharge port, and wherein a distal end of the baffle is located above a bottom of the through-hole.

5. The smoke generator using dry ice as claimed in claim 4, further comprising a smoke discharge valve pivotably mounted to the smoke discharge port and located in the second chamber, wherein the smoke discharge valve normally blocks the through-hole of the overflow preventing member when not subject to force, wherein when the first chamber is filled with smoke and the internal pressure in the first chamber is larger than a sum of a pressure in the second chamber and a weight of the smoke discharge vale, the smoke in the first chamber pushes open the smoke discharge valve and enters the second chamber via the through-hole and the smoke discharge port.

6. The smoke generator using dry ice as claimed in claim 1, wherein the separation member includes a thermally insulating layer spaced from the water draining port.

7. The smoke generator using dry ice as claimed in claim 1, wherein the separation member includes an enclosing wall around the water draining port, wherein the enclosing wall includes a plurality of holes configured to permit passage of water through the water draining port.

8. The smoke generator using dry ice as claimed in claim 1, further comprising:

a basket detachably mounted in the first chamber, wherein the basket includes plurality of water draining holes, wherein the dry ice is received in the basket.

9. A smoke generator using dry ice, comprising:

a casing including a first chamber, a second chamber, and a third chamber, wherein the casing includes an outer side having a smoke outlet intercommunicating with the second chamber, wherein the first chamber includes a smoke discharge port intercommunicating with the second chamber, wherein the first chamber is configured to receive dry ice, and wherein the second chamber is configured to receive water;

a water pump device fixed in the third compartment and configured to deliver water in the second chamber to the first chamber, wherein the dry ice contacts with the water and gasifies into smoke that enters the second chamber via the smoke discharge port and is then ejected out via the smoke outlet, wherein the water in the first chamber is flowable back to the second chamber;

a heater disposed in the second chamber and configured to increase a temperature of the water; and an isolation cap including a front opening intercommunicating with the smoke outlet and a lower opening intercommunicating with the front opening, wherein the first chamber is defined by a peripheral wall located in the second chamber and a bottom wall located at a bottom end of the peripheral wall and extending inclinedly, wherein the smoke discharge port is misaligned from the smoke outlet, wherein the isolation cap is fixed between the peripheral wall and the smoke outlet and is misaligned from the smoke discharge port, and wherein the lower opening faces the smoke discharge port and intercommunicates with the second chamber.

10. The smoke generator using dry ice as claimed in claim 9, further comprising:

a basket detachably mounted in the first chamber, wherein the basket includes plurality of water draining holes, wherein the dry ice is received in the basket.

11. A smoke generator using dry ice, comprising:

a casing including a first chamber, a second chamber, and a third chamber, wherein the casing includes an outer side having a smoke outlet intercommunicating with the second chamber, wherein the first chamber includes a smoke discharge port intercommunicating with the second chamber, wherein the first chamber is configured to receive dry ice, and wherein the second chamber is configured to receive water;

a water pump device fixed in the third compartment and configured to deliver water in the second chamber to the first chamber, wherein the dry ice contacts with the water and gasifies into smoke that enters the second chamber via the smoke discharge port and is then ejected out via the smoke outlet, wherein the water in the first chamber is flowable back to the second chamber;

a heater disposed in the second chamber and configured to increase a temperature of the water; and an overflow preventing member is disposed at the smoke discharge port and is located in the second chamber, wherein the overflow preventing member includes a coupling portion disposed around the smoke discharge port and a baffle having an end coupled to the coupling portion, wherein the coupling portion includes a through-hole aligned with the smoke discharge port, and wherein a distal end of the baffle is located above a bottom of the through-hole.

12. The smoke generator using dry ice as claimed in claim 11, further comprising a smoke discharge valve pivotably mounted to the smoke discharge port and located in the second chamber, wherein the smoke discharge valve normally blocks the through-hole of the overflow preventing member when not subject to force, wherein when the first chamber is filled with smoke and the internal pressure in the first chamber is larger than a sum of a pressure in the second chamber and a weight of the smoke discharge vale, the smoke in the first chamber pushes open the smoke discharge valve and enters the second chamber via the through-hole and the smoke discharge port.

* * * * *